United States Patent [19]

Kerschner

[11] 4,362,428

[45] Dec. 7, 1982

[54] EXPANSION SEAL

[75] Inventor: James J. Kerschner, Tonawanda, N.Y.

[73] Assignee: Acme Highway Products Corporation, Amherst, N.Y.

[21] Appl. No.: 218,702

[22] Filed: Dec. 22, 1980

[51] Int. Cl.[3] ..... E01C 11/10

[52] U.S. Cl. ..... 404/64; 404/68; 49/475; 52/396

[58] Field of Search ..... 404/64, 65, 68, 69, 404/47, 48; 52/396, 403; 49/475

[56] References Cited

U.S. PATENT DOCUMENTS

| | | | |
|---|---|---|---|
| 3,606,826 | 9/1971 | Bowman | 404/64 X |
| 3,608,442 | 9/1971 | Berchou | 404/65 |
| 3,762,826 | 10/1973 | Bowman | 404/64 |
| 3,776,654 | 12/1973 | Brown | 404/65 |
| 3,918,824 | 11/1975 | Bowman | 404/64 |
| 4,098,043 | 7/1978 | McCready | 404/65 X |

FOREIGN PATENT DOCUMENTS

| | | | |
|---|---|---|---|
| 586790 | 4/1977 | Switzerland | 404/64 |

*Primary Examiner*—Nile C. Byers, Jr.

*Attorney, Agent, or Firm*—Christel, Bean & Linihan

[57] ABSTRACT

An expansion joint seal for closing a gap between spaced-apart structural members has an elongated body including longitudinal side edges, an upper corrugated treadway surface, a lower undersurface, and an internal web structure including a plurality of laterally spaced vertically disposed webs each having an upper pair of cross-bars extending upwardly and outwardly therefrom and connected to the upper treadway and a lower pair of cross-bars extending downwardly and outwardly therefrom. An additional lower cross-bar extends from each side edge downwardly and inwardly to a pair of curved surfaces, and a vertically disposed web extends between the juncture of the curved surfaces and the centermost cross-bars. An upper cross-bar extends upwardly and inwardly from each side edge to the upper treadway surface.

6 Claims, 3 Drawing Figures

EXPANSION SEAL

BACKGROUND OF THE INVENTION

The present invention relates to an expansion joint seal of the type used for sealing an expansion gap against the intrusion of dirt, water and other debris, as for example might be encountered by expansion joints in a pedestrian walkway or concourse. More specifically, the present invention relates to an elastomeric expansion seal adapted to be positioned between a pair of spaced-apart, structural slab members or the like; and wherein the seal is of the type having substantially vertically disposed sidewalls, an upper treadway surface and a lower surface, and an internal webbing structure permitting the seal to expand and contract with contraction and expansion of the structural members to which it is affixed.

Seals of this general type are known in the art. The seal of the present invention is suitably modified to be especially suited for sealing structural members that may have relatively larger size gaps therebetween.

One of the problems associated with expansion seals for large gapsor those having relatively high width to height ratios is that of maintaining an adequate sealing pressure between the side edges of the seal and the respective contacting side edges of the structural slab members when the seal is at or near its maximum position of expansion in response to expansion of the gap due to changing environmental or structural conditions or the like.

Another related problem is the prevention of buckling or collapsing of the seal as the same is made larger in width relative to its height.

It is also desirable, especially in concourse or walkway expansion joints, to maintain the degree of vertical seal "growth" as small as possible as the same moves to its contracted position in response to contraction of the gap such that the upper surface stays relatively flush with the walkway surface thereby to avoid tripping or the like which may be caused by uneven surfaces.

SUMMARY OF THE INVENTION

It is, accordingly, an object of the present invention to provide an expansion joint seal especially suited for larger size gaps between spaced-apart structural members wherein the internal webbing structure of the seal is so constructed and arranged as to maintain adequate sealing contact with such structural members, especially in the expanded positions thereof, while at the same time avoiding excessive side wall pressures in the contracted positions thereof.

Another object is to provide the foregoing in a construction having sufficient structural integrity to adequately support vertical loadings without buckling, collapsing or weakening of the sealing contact between the seal and the structural members.

It is a further object of the invention to provide in a seal of such construction little or negligible vertical "growth" as the seal moves to its contracted position.

BRIEF DESCRIPTION OF THE DRAWING

For a fuller understanding of the present invention reference should now be made to the following detailed description of an illustrative embodiment thereof taken in conjunction with the accompanying drawing, wherein like reference numerals denote like parts throughout the various views and wherein.

DETAILED DESCRIPTION OF THE ILLUSTRATED EMBODIMENT

Referring in detail to the illustrative embodiment depicted in the accompanying drawing, there is shown an elongated, resiliently yieldable expansion seal, generally designated 10 and which is constructed in accordance with this invention.

Sealing member 10 preferably is composed of a resiliently yieldable elastomeric material, such as neoprene, for example, or any other elastic material having similar properties of durability, sufficient compression and expansion capabilities, and high abrasion resistance and which is capable of withstanding temperature extremes, sunlight, weathering, oxidation and deleterious chamicals. Sealing member 10 is formed of a unitary, one-piece construction by a suitable extrusion process and can be of any length desired. While sealing member 10 can take various outside dimensions to conform to the width of the gap which it is to span, the width would be generally of a significantly greater dimension than the height or vertical extent thereof for the purpose of spanning large or high width to height ratio gaps. Also, it should be understood that although sealing member 10 is especially adapted for use between adjacent pavement slabs of a concourse or walkway, it has general utility in various expansion joint applications such as those employed in highways, sidewalks, airfields, building structures and the like. In this connection, it is to be noted that various terms such as "vertical", "horizontal" or "lateral" and "upper" or "lower" and the like employed in connection with description of the invention are used for convenience and ease in describing the same; and it is to be understood that the present invention is not to be limited by the particular orientation the expansion seal member 10 may take.

Figure 1:
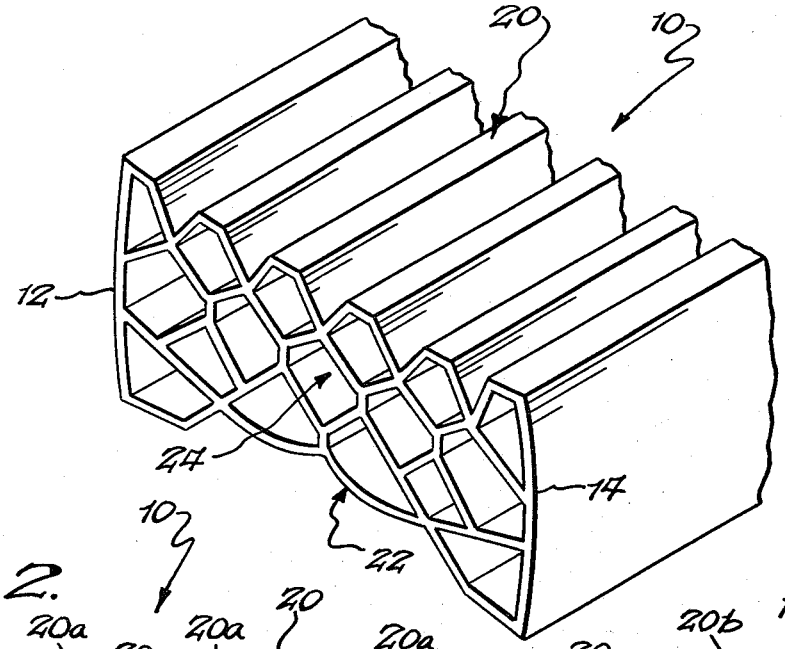
FIG. 1 is a partial fragmentary perspective view of a seal of the invention.
Figure 2:
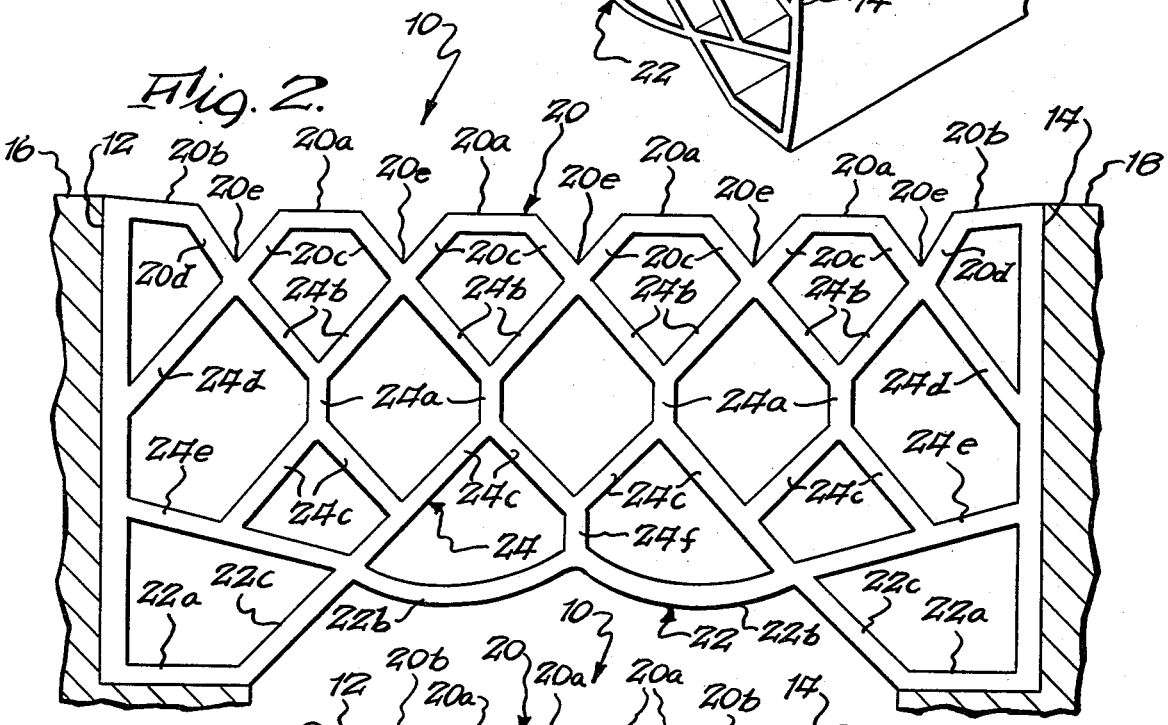
FIG. 2 is a vertical sectional view of the seal of FIG. 1 depicting the same in operative position between a pair of spaced-apart structural elements.
Figure 3:
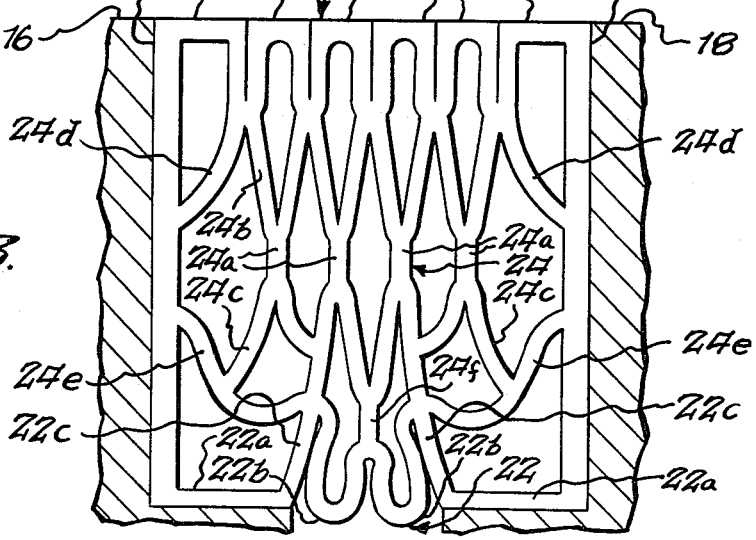
FIG. 3 is a view similar to FIG. 2 but depicting the seal in its fully contracted position.

In the non-installed condition of the seal 10, as depicted in FIG. 1, it has a pair of longitudinally extending side edges 12, 14 each of which has a slight curvature facing inwardly toward the center of the seal, whereas in its operative or assembled position, as depicted in FIGS. 2 and 3, these curved side edges are compressed in conformity to the straight or substantially planar facing side faces of a spaced-apart pair of structural slabs or similar structural members 16 and 18 of conrete, metal or other conventional construction.

Sealing member 10 includes an upper treadway surface 20 integrally connected to the top of each of the side edges 12 and 14 thereof, a lower undersurface 22 vertically disposed below the upper treadway surface and integrally connected to the bottom of each of side edges 12 and 14, and, in accordance with the characterizing features of the present invention, an internal web structure 24 especially constructed for larger size gaps and located interiorly within the confines of the seal side edges 12 and 14, the upper treadway surface 20 and the undersurface 22.

As illustrated, the upper treadway surface is of corrugated construction including a plurality of spaced, substantially horizontal planar surfaces 20*a* and a pair of outermost planar surfaces 20*b* which incline slightly downwardly and inwardly from side edges 12 and 14. Each planar surface 20*a* has depending outwardly and downwardly therefrom a pair of legs 20*c* which, together with legs 20*d* depending downwardly and inwardly from outermost surfaces 20*b*, define a plurality of substantially V-shaped grooves 20*e*.

The undersurface 22 of seal 10 comprises a pair of opposed, laterally spaced substantially horizontal planar mounting portions 22*a* extending inwardly from side walls 12, 14 and which are suitably affixed in sealing engagement with horizontally inwardly extending shelf sections of structural members 16 and 18. Undersurface 22 further comprises a pair of adjacent outwardly curved surfaces 22*b* spaced upwardly and inwardly of mounting portions 22*a* and integrally connected thereto by means of a pair of upwardly and inwardly extending members 22*c* which join the outer edge of each curved surface 22*b* with its respective mounting portion 22*a* at the inward extremity thereof. The curved surfaces 22*b* are centrally located within the width of seal member 10 and are joined in substantial vertical alignment with the innermost groove 20*e* of upper treadway surface 20.

The interior structure of the seal assembly according to the present invention includes a plurality of laterally spaced, vertically disposed webs or struts 24*a* located about midway between the upper and lower seal surfaces and in substantial vertical alignment with the centers of the planar surfaces 20*a* of upper treadway surface 20. Extending upwardly and outwardly from the upper end of each web 24*a* is a pair of cross-bars 24*b*. Similarly, a pair of downwardly and outwardly extending cross-bars 24*c* depends from the lower end of each web 24*a*. The outermost cross-bars 24*b* are generally aligned with legs 20*d*, being integrally connected thereto and to respective cross-bars 24*d* extending inwardly and upwardly from slightly above the mid-points of seal side edges 12 and 14, cross-bars 24*d* being substantially aligned with the outermost legs 20*c* and joined thereto and to cross-bars 24*b* and legs 20*d* at the juncture of legs 20*c* and 20*d* forming the outermost V-shaped grooves 20*e* of the upper treadway surface 20. All the other upper cross-bars 24*b* intersect or join each other where legs 20*c* join to define V-shaped grooves 20*e*, being substantially aligned with the other legs 20*c*.

The outer cross-bars 24*c* are integrally connected to respective cross-bars 24*e* extending inwardly and downwardly from slightly below the mid-points of seal side edges 12 and 14 to the intersection of members 22*c* and the outer extremities of curved surfaces 22*b*; with outer cross-bars 24*c* joining cross-bars 24*e* generally centrally thereof. The inner cross-bars 24*c* of the outermost pairs thereof are integrally connected intermediate the ends of the adjacent cross-bars 24*c* which join, and are in substantial alignment with, the respective members 22*c* at the intersection between cross-bars 24*e*, curved surfaces 22*b* and members 22*c*. Completing the interior webbed structure of the seal is a vertically disposed strut or web 24*f* vertically aligned with central groove 20*e* of the upper treadway surface and integrally connected at its lower end to the joinder of curved surfaces 22*b* and at its upper end to the juncture of cross-bars 24*c* extending downwardly and inwardly from the two innermost webs 24*a*.

From the foregoing, it should be readily apparent that cross-bars 24*e*, which are more nearly horizontal than vertical, are generally aligned with the bottom wall curved surfaces 22*b*, in effect comprising extensions or continuations thereof and functioning to reinforce and give rigidity to their respective side edges 12 and 14 to thereby maintain the seal in intimate sealing contact with the structural members 16 and 18 even in positions near or at the maximum extension of the seal, e.g. at 85% of nominal width. At the same time, the relatively open internal structure permits compression without developing excessive reaction forces. Further, the plurality of vertical webs 24*a* together with vertical web 24*f* and the plurality of cells defined by the various web, leg and cross-bar members provide vertical strength to the seal assembly such that the same can adequately support vertical loads in all positions thereof without buckling or collapsing. Moreover, treadway members 20*b* incline slightly downwardly and inwardly, and members 20*a* are offset slightly below the walkway surface when the seal is open. As can be seen in FIG. 3, in the compressed condition of the seal the vertical "growth" of the upper treadway surface is negligible. Thus, such treadway remains substantially flush with the walkway surface in all positions of the seal, thereby preventing tripping or the like.

Although a preferred embodiment of the present invention has been described, changes will obviously occur to those skilled in the art without departing from the spirit thereof. It is therefore intended that the present invention be limited only by the scope of the appended claims.

What is claimed is:

1. An expansion joint seal for effectively sealing relatively larger size gaps between spaced-apart structural members while providing adequate vertical support, said seal comprising:

an elongated body including longitudinal side edges, an upper corrugated treadway surface integrally connected to an upper portion of each of said side edges, a lower undersurface integrally connected to a lower portion of each of said side edges, and an internal web structure confined within the boundaries of said longitudinal side edges, said upper treadway surface and said lower undersurface, said internal web structure comprising:

a plurality of laterally spaced, vertically disposed webs, an upper pair of cross-bars extending upwardly and outwardly from the upper end of each of said vertically disposed webs and connected to said upper treadway surface, a lower pair of cross-bars extending downwardly and outwardly from the lower end of each of said vertically disposed webs and connected to said lower undersurface;

a central, vertically disposed lower web integrally connected at its upper end to one cross-bar each of an adjacent pair of said lower cross-bars and integrally connected at its lower end to said undersurface;

additional lower cross-bars extending from said side edges downwardly and inwardly and directly connected to said undersurface, the outermost ends of each of the outermost of said lower cross-bars joining the adjacent additional lower cross-bar intermediate the ends thereof; and the lower cross-bars extending downwardly and inwardly from the outermost of said vertically disposed webs being integrally connected with the lower cross-bars extending downwardly and outwardly from the inwardly adjacent vertically disposed webs at a point intermediate the ends of said last-named cross-bars.

2. The improvement according to claim 1, wherein:

said undersurface includes a centrally located pair of curved surfaces, and said central, vertically disposed lower web integrally connects at its lower end to the juncture of said curved surfaces.

3. The improvement according to claim 2 wherein:

said additional lower cross-bars are connected to the respective outer extremities of said curved surfaces.

4. The improvement according to claim 3, wherein:

said side edges are curved prior to installation and are compressed to conform to the shape of the structural members after installation.

5. The improvement according to claim 4, wherein:

said upper treadway surface comprises a plurality of spaced planar surfaces with a plurality of substantially V-shaped grooves between said planar surfaces; and wherein each of the cross-bars of said upper pairs of cross-bars extends to a different one of said grooves.

6. The improvement according to claim 5, further comprising:

additional upper cross-bars extending from each of said side edges upwardly and inwardly to the outermost of said grooves and joined thereat to the outermost cross-bars of said upper pairs of cross-bars; and said additional upper cross-bars being vertically spaced above said additional lower cross-bars.

* * * * *